US007815477B2

(12) United States Patent
Garofalo

(10) Patent No.: US 7,815,477 B2
(45) Date of Patent: Oct. 19, 2010

(54) SWIMMING FLIPPER

(75) Inventor: Giovanni Garofalo, Rapallo (IT)

(73) Assignee: Mares S.p.A., Rapallo (IT)

( * ) Notice: Subject to any disclaimer, the term of this patent is extended or adjusted under 35 U.S.C. 154(b) by 0 days.

(21) Appl. No.: 12/237,534

(22) Filed: Sep. 25, 2008

(65) Prior Publication Data

US 2009/0088036 A1 Apr. 2, 2009

(30) Foreign Application Priority Data

Sep. 28, 2007 (IT) ..... GE2007A0093

(51) Int. Cl.
*A63B 31/08* (2006.01)

(52) U.S. Cl. ..... 441/64

(58) Field of Classification Search ..... 441/61, 441/62, 63, 64

See application file for complete search history.

(56) References Cited

U.S. PATENT DOCUMENTS

| | | | | |
|---|---|---|---|---|
| 3,411,165 | A * | 11/1968 | Murdoch | 441/64 |
| 4,209,866 | A * | 7/1980 | Loeffler | 441/64 |
| 4,300,255 | A * | 11/1981 | Beuchat | 441/64 |
| 6,290,561 | B1 | 9/2001 | Garofalo et al. | |
| 6,918,805 | B2 * | 7/2005 | McCarthy | 441/64 |

* cited by examiner

*Primary Examiner*—Lars A Olson
(74) *Attorney, Agent, or Firm*—Stites & Harbison PLLC; Marvin Petry

(57) ABSTRACT

Swimming flipper comprising a shoe part from which two ribs extend laterally, and a fin part, characterised in that said fin part is connected at one end to said shoe part, while its other end is constrained to said ribs in the vicinity of their ends, the sides of said fin part being at least partly not constrained in any way to the said side ribs, all of which so that during the active and passive phases of the flipper movement the free part and the constrained part of the said fin bend in the opposite directions forming substantially an S shape.

13 Claims, 6 Drawing Sheets

SWIMMING FLIPPER

FIELD OF THE INVENTION

The present invention relates to swimming flippers.

BACKGROUND AND SUMMARY OF THE INVENTION

All conventional flippers suffer from a series of problems, in particular:

1) Deformation of the Flipper During Swimming

All conventional flippers, during the swimming movement, are subject to deformation which does not allow ideal channelling of the fluid flows. In fact, as schematically shown in FIG. 1 of the accompanying drawings, only one component F1 of the thrust produced by the flipper P is positive, while there is always a vertical component F2 which represents a loss in efficiency.

During a flipper movement against the direction of flow or when the diver must perform strong flipper movements, for example when in a very negative postural condition or when a high speed is required, deformation of the flipper P increases, as schematically shown in FIG. 2, resulting in a further increase in the loss of efficiency F2 and a consequent reduction of the active component F1.

On the market there therefore exist "rigid" flippers which are normally used by more demanding and expert divers and which, when a strong thrust is required, do not bend excessively and therefore ensure a good performance in these conditions.

On the other hand, these flippers require a considerable amount of force and well-trained leg muscles. Moreover, during the flipper movement performed in normal swimming conditions, they do not bend enough and therefore do not generate a good thrust.

Conversely, flippers which are too "soft" will function well during a supple flipper swimming action, but will bend too much in more stressful conditions, as shown in FIG. 3 where it can be seen that the component F1 is practically zero, while the component F2 prevails.

2) Angle of Attack

Since the human foot forms an angle with the leg, if flippers with a "flat" fin, i.e. fin extending along the plane of the foot sole, were to be used, a very poor efficiency during the downwards movement would be obtained.

For some time now, flipper manufacturers have adopted the special measure of inclining the flipper fin a few degrees in order to obtain a better angle of attack, in particular during a downwards flipper swimming movement.

This angle, however, is the result of a compromise since it cannot be too pronounced otherwise there would be a loss of efficiency during the upwards flipper swimming movement.

In order to improve this aspect, European patent No. 1127589 in the name of the same Applicant proposes a flipper with a pivoting fin and with an angular movement controlled by a number of mechanical constraints, able to achieve a far more favourable angle of attack during the two flipper swimming movements.

This solution undoubtedly increases the efficiency of the flipper, but does not solve the problem described under point 1.

3) Thrust "Dead" Zones

During the alternating movement of the flipper, the latter must pass from optimum deformation in one direction to deformation in the opposite direction, when the leg movement is reversed. In order to pass from one deformed condition into the other a certain amount of time is required. During this time period the flipper provides practically no thrust. Two "dead" angles, as indicated by a negative sign in FIG. 4, therefore occur during the flipper movement. In order to be able to reduce these angles, various solutions have been used. The solution used in European patent No. 1127589 mentioned above, owing to the hinge which allows a certain freedom of movement of the fin, is also able to minimize these dead angles, as graphically shown in the diagram of FIG. 5. In this case also, however, the problem described under point 1 is not solved.

4) Channelling of the Fluid Flow

In order to improve the efficiency of the flippers, systems which are able to better channel the fluid flow have been developed so as to displace a greater quantity of water in the direction of the movement. The problem with these flippers, however, arises during slow swimming and, in particular, when subject to considerable forces since, being a relatively "soft" flipper, the latter deforms excessively with a consequent loss of thrust and efficiency.

5) Fatigue During Swimming

All the technical solutions described above tend, in particular, to improve the efficiency of the flipper. In fact, the most important characteristic to be achieved is that of maximum thrust with minimum effort. In this respect the thrust which may be obtained by "normal size" flippers cannot be increased beyond a certain value and also the maximum speed which can be obtained with a flipper cannot exceed certain values, also because the resistance of the water increases with the square of the speed.

It is therefore important to have a compact flipper which produces a good thrust, but which requires the minimum amount of effort possible during both slow and fast swimming. This means, in the case of free divers, that they are able to spend more time underwater and, in the case of scuba divers using autonomous breathing equipment, that they are able to spend longer periods under water as a result of a smaller air consumption due to less fatigue.

In addition there is less risk of suffering cramps, in particular in the case of divers with lower fitness levels.

The flipper according to the present invention aims to solve all of the abovementioned problems, offering optimum thrust characteristics with a very small amount of effort.

Further advantages which may be obtained with the flipper according to the present invention are as follows:

Possibility of varying the deformation with a consequent change in characteristics from "harder" to "softer".

Possibility of manufacture using various technologies and constructional solutions so as to provide flippers with different price and performance levels, but all characterized by the same operating principles.

The main object of the invention is therefore to obtain a flipper which, during swimming, is deformed in the manner of an "S", i.e. with a double bend, instead of a single bend as is the case with all the commercially available flippers. Obviously, this double bend must be present both during the upward movement and during the downward movement, as shown schematically in the accompanying FIGS. 6 and 7.

The advantages of this solution are immediately obvious.

There is no longer the loss of efficiency present in conventional flippers, owing to channelling of the fluid flow in the direction of the movement and acceleration of the same outgoing flow.

The thrust will therefore be greater and the energy required to move the flipper decidedly smaller, owing to the increase in efficiency.

The principle is simple and can be easily understood, but the difficulty is how to obtain this double-bend deformation.

The innovative solution able to achieve this result is that of allowing a part of the flipper, i.e. the more central part, to be deformed under force, while the part furthest from the foot is substantially fastened to the more rigid side ribs or to the fin support structure.

A first solution is that shown schematically in FIG. 8 where the central part of the fin 3 is free to move and is guided, in its terminal zone, by two transverse contact elements 4 and 4' fixed to the ribs 2.

The result, therefore, is that, during swimming, the central part of the fin 3 will tend to flex easily, while the terminal part 3', which is forced to slide inside the transverse guides 4, 4' fixed to the ribs 2, will bend in the opposite direction to the bend formed by the fin 3.

By positioning the transverse guides 4, 4' at different points along the ribs 2 (as shown schematically in FIG. 9) or by changing the rigidity of the fin 3 or the initial flexing point, two S-shaped curvatures with a substantially different amplitude and shape—and consequent different "hardness" and thrust characteristics of the fin 3—will be obtained.

In a simplified version of the flipper, the fin 33 may be formed as one piece, without the transverse guides, only the central part of the fin 33 being no longer connected to the ribs 2, as schematically shown in FIGS. 10 and 11. An S-shaped deformation of the fin 33 will also be obtained in this case during swimming.

With these technical solutions the problems mentioned under points 1, 2 and 3 are brilliantly solved.

In order to solve also the problem of channelling of the fluid flow it is sufficient to add deformable folding side pockets 6 which will be able not only to ensure a good "channel effect" but also to operate as deformation limiters for the central part of the fin 3 or 33 (FIGS. 12 and 13).

Obviously the materials used for the fin and shoe of the flipper may vary greatly, from thermoplastic rubbers to engineering polymers, composites and combinations of all these or other materials or technological manufacturing solutions such as overmoulding or mechanical assembly of the flipper components, without, however, departing from the scope of protection of the present invention.

DESCRIPTION OF SOME PREFERRED EMBODIMENTS OF THE INVENTION

Two preferred embodiments of a flipper according to the present invention will be described below with particular reference to FIGS. 14, 15, 16 and 17 of the accompanying drawings.

Figure 1:
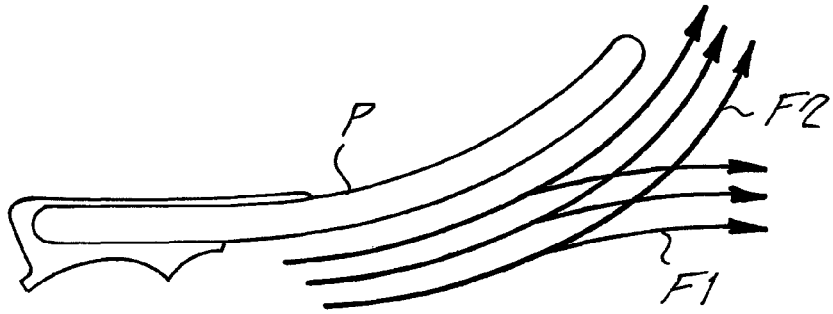
FIG. 1 is a schematic view showing the components of the thrust produced by a flipper.
Figure 2:
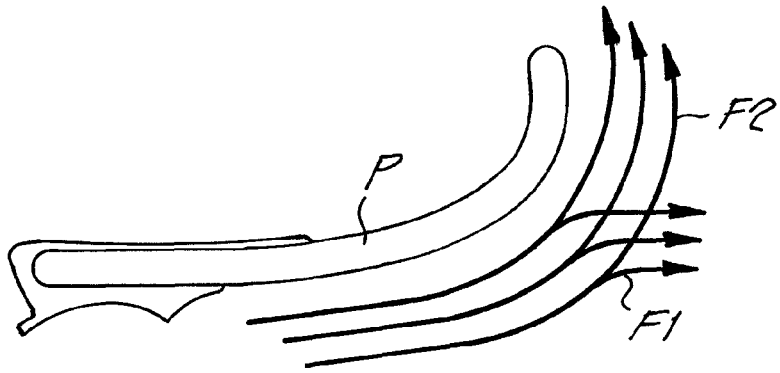
FIG. 2 is a schematic view similar to that of FIG. 1, showing how the deformation of the flipper when a high speed is required is introducing an increase of the loss of efficiency of the thrust of the flipper.
Figure 3:
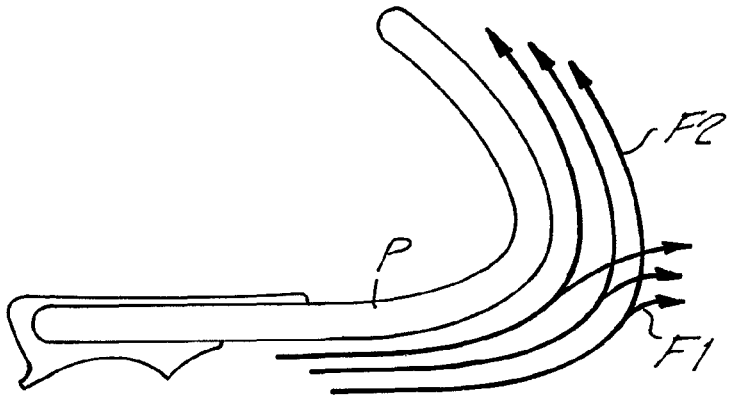
FIG. 3 is a schematic view showing the loss of efficiency of a "soft" flipper.
Figure 4:
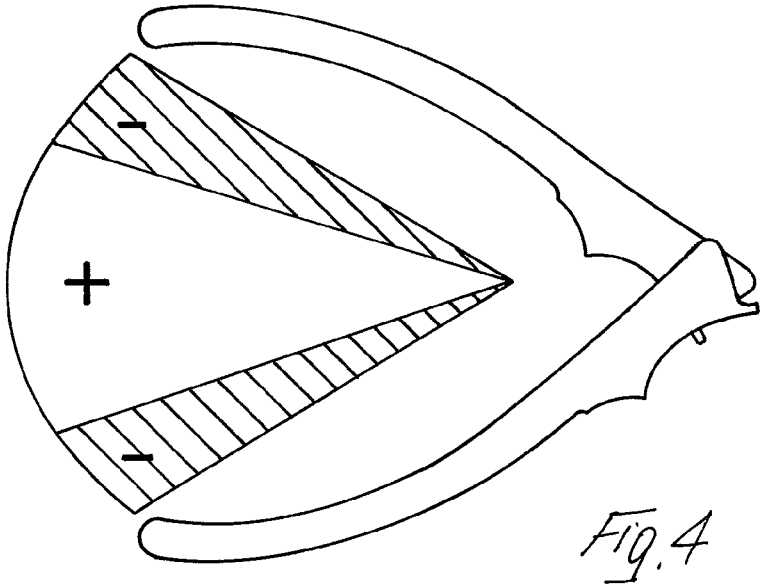
FIG. 4 is a schematic view showing the dead angles formed during the movement of a prior art flipper.
Figure 5:
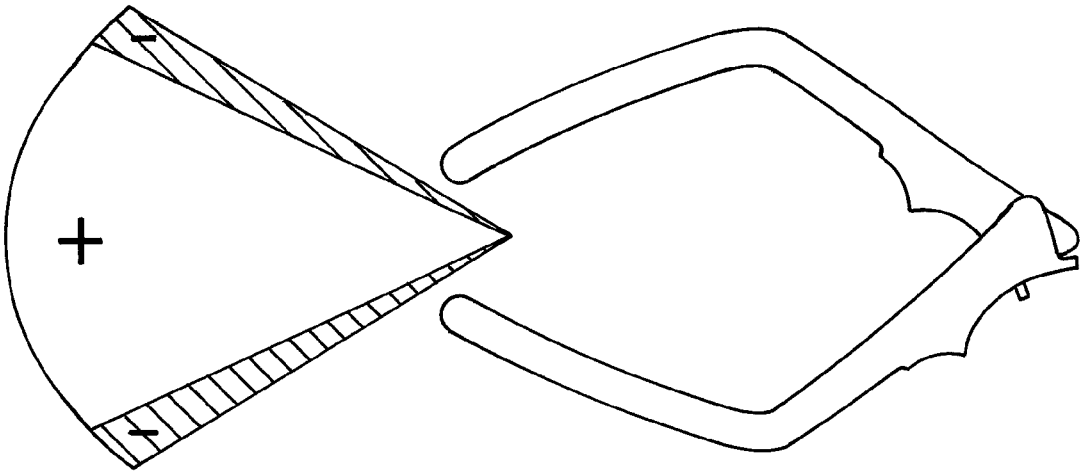
FIG. 5 is a schematic view showing the dead angles formed during the movement of a flipper according to EP 1127589.
Figure 7:
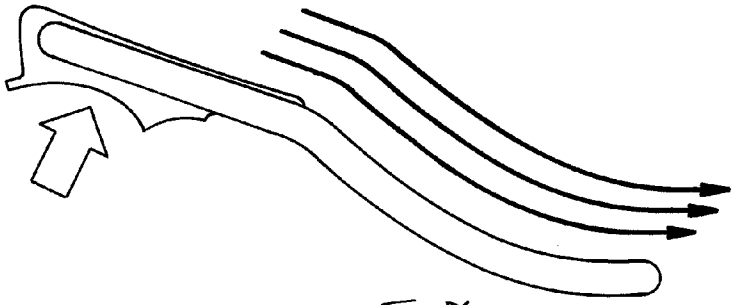
FIGS. 6 and 7 shows schematically the theoretic optimal, double bend, condition which to be assumed by a flipper during the upward and the downward movement of a flipper.
Figure 6:
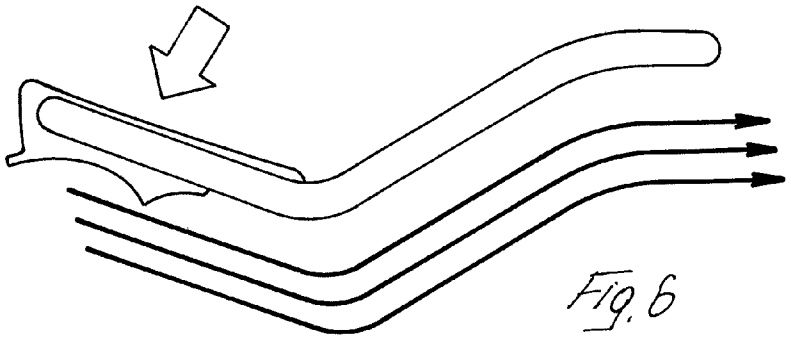
Figure 9:
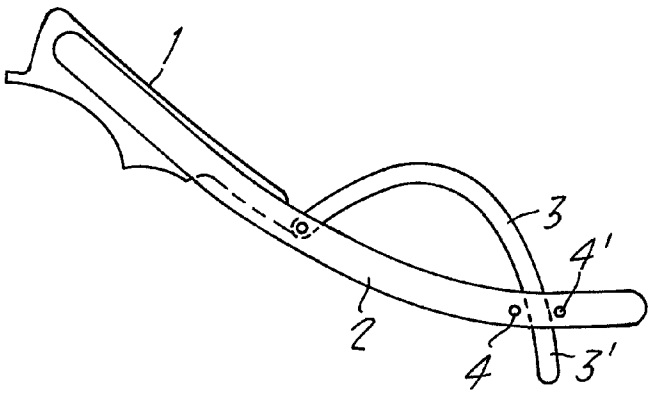
FIGS. 8 and 9 shows schematically a first embodiment of a flipper according to the invention.
Figure 8:
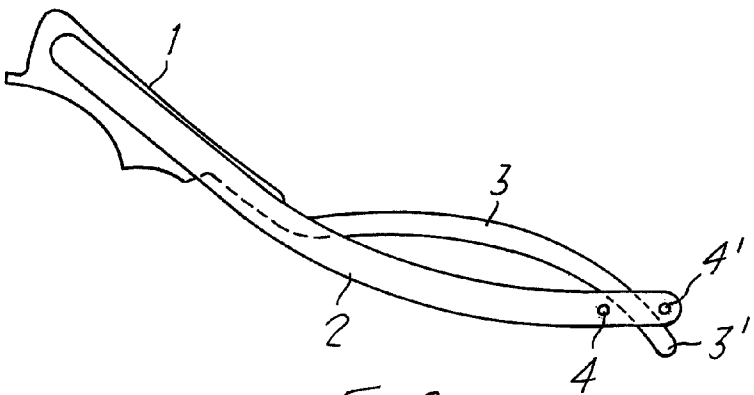
Figure 11:
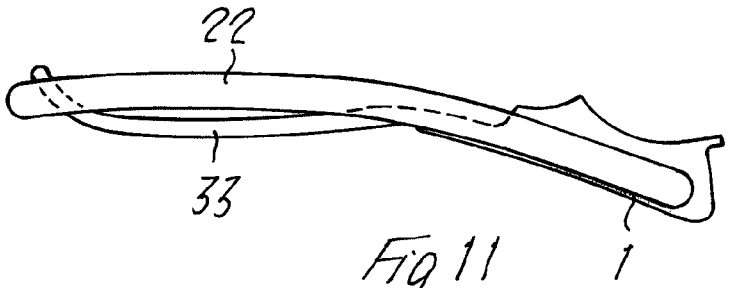
FIGS. 10 and 11 shows schematically a second embodiment of a flipper according to the invention
Figure 13:
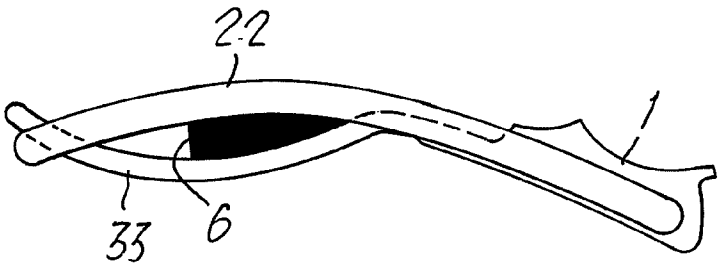
FIGS. 12 and 13 shows schematically still another embodiment of a flipper according to the invention.
Figure 10:
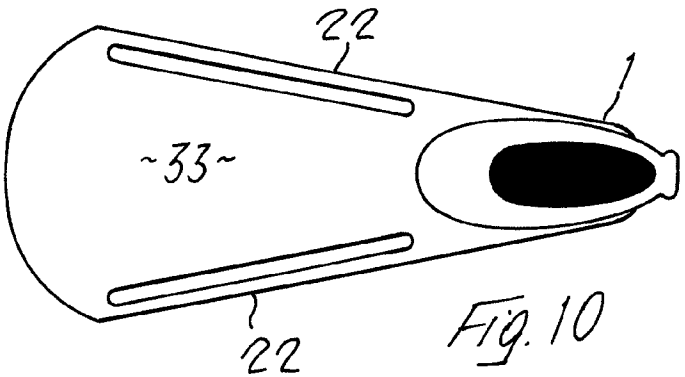
Figure 12:
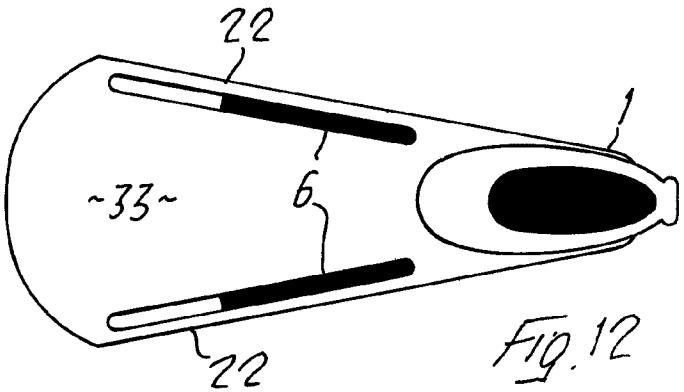
Figure 14:
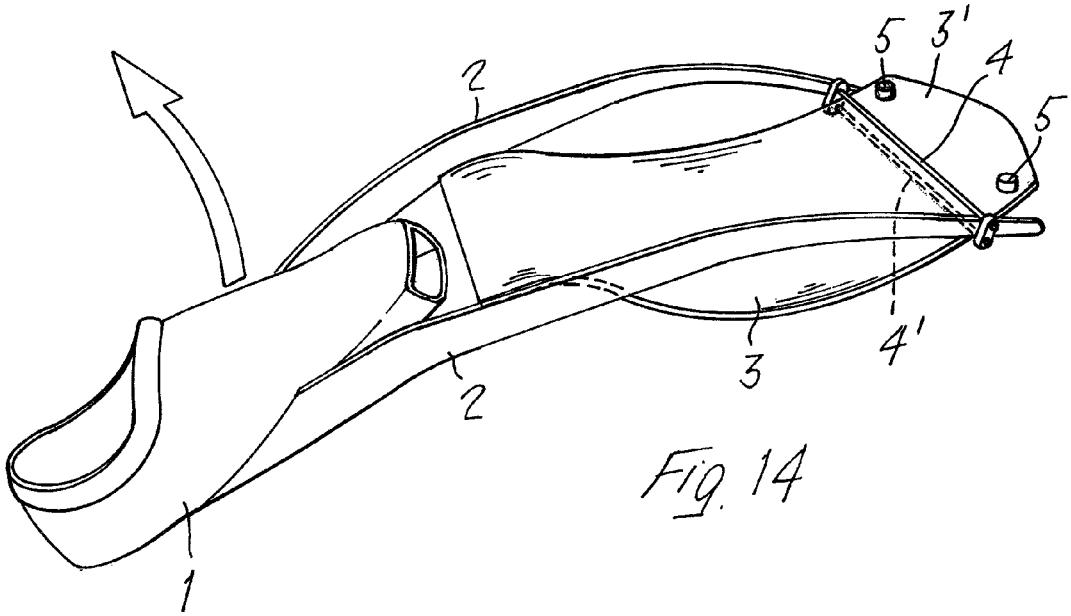
FIGS. 14, 15 and 16 shows a preferred embodiment of a flipper according to the invention.

With reference first of all to FIG. 14, 1 denotes the shoe part of a flipper of the closed-shoe type. Obviously, this flipper could also be of the open-shoe type. The two ribs 2 extend from the sides of the shoe part 1. While the shoe part is preferably made of elastomer material which has the softness of rubber, the ribs 2 are made with a material which is relatively more rigid or has a thickness such as to increase the rigidity thereof. For this purpose they may also be reinforced with suitable reinforcing materials such as metal, very hard plastics, engineering polymers or the like. 3 denotes the fin part of the flipper. As shown, this fin part 3 is constrained to the shoe part 1 in the vicinity of the toe end of the shoe 1, while it is not constrained laterally in any way to the ribs over its entire length, so that it is free to flex in any direction. The fin 3 is made preferably of the same material as the shoe 1 and has a length preferably slightly greater than the length of the ribs 2. The ribs 2 are connected together in a zone close to their free end by a pair of transverse guide elements 4, 4' which are spaced from each other by an amount equal to or slightly greater than the thickness of the fin 3. The free end 3' of the fin 3 is passed through the space in between the two guide elements 4, 4', and suitable contact parts 5 mounted on the fin part 3' projecting beyond the guide elements 4, 4' prevent the fin part 3' from coming out of these guide elements.

During swimming, the central part 3 of the fin will tend to flex easily, but the terminal part 3' of this fin which is forced to slide inside the transverse guides 4, 4' fixed to the ribs will curve in the opposite direction to the former.

Figure 15:
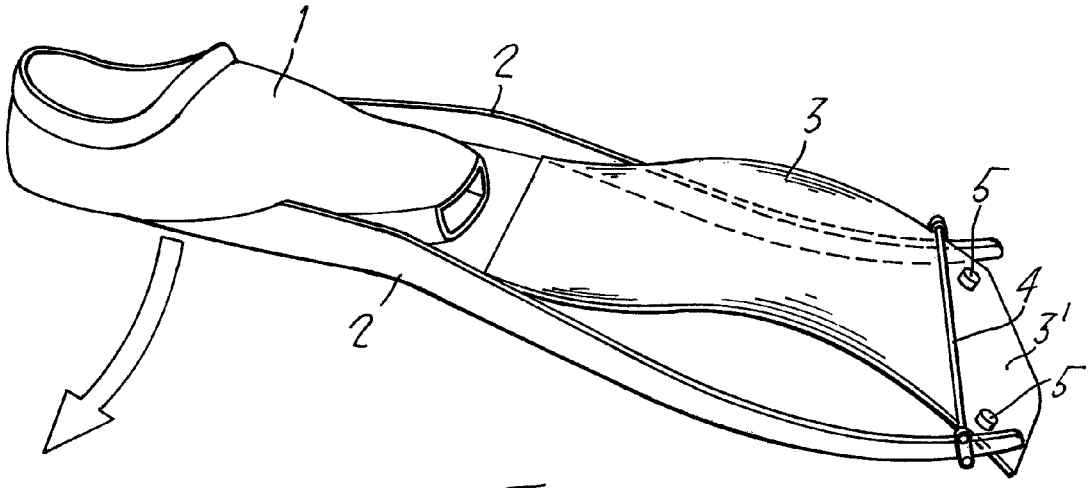
Figure 16:
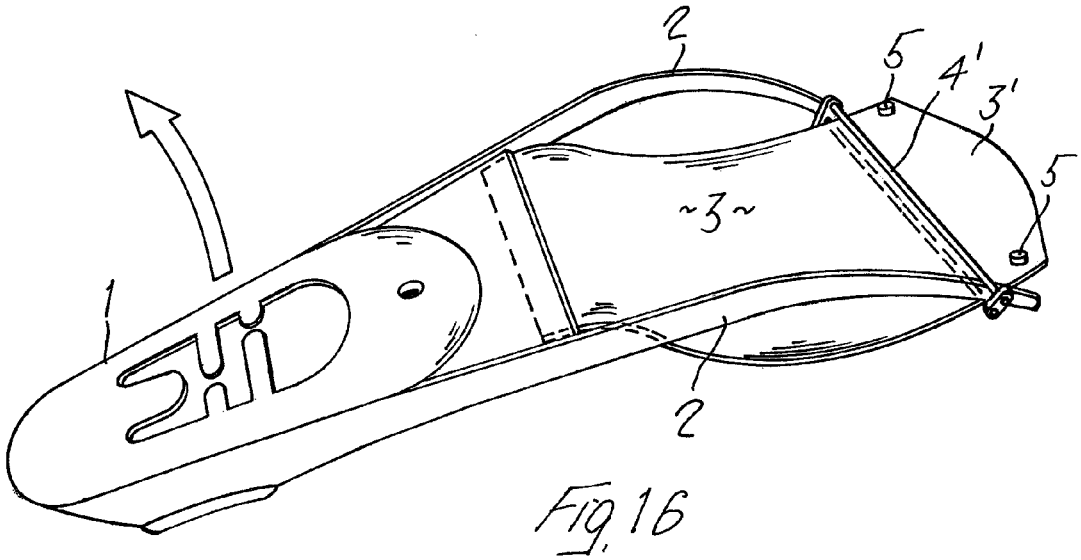

FIG. 14 shows the return phase of the flipper movement, while FIGS. 15 and 16 (viewed from below) shows the "active" phase of the flipper movement. It can be seen that, during both these movements, the flipper flexes substantially in the manner of an S so as to make maximum use of the propulsive thrust.

Obviously, by positioning the transverse guides at different points or by changing the rigidity of the fin or the initial flexing point it is possible to obtain, as already mentioned above, S-shaped curvatures with a varying amplitude and shape and consequent different "hardness" and thrust characteristics of the fin.

Figure 17:
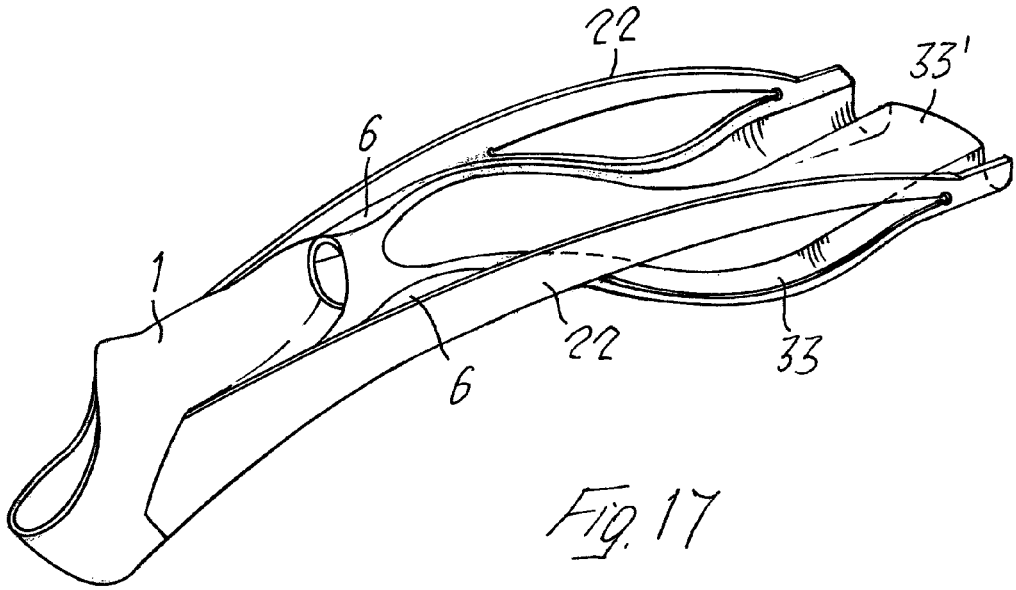
FIG. 17 is still another embodiment of a flipper according to the invention.

Finally, FIG. 17 shows a simplified embodiment of the flipper according to the invention. In this embodiment the transverse guides 4, 4' are no longer present, their function instead being performed by connecting the front end of the fin 33 to the ends of the ribs 22. In this case also, the front part 33' of the fin will flex in the opposite direction to flexing of the part 33 of the said fin. In this same figure it can also be seen that the base of the free part of the fin 33 does not adjoin the end of the shoe 1, but is spaced at a certain distance from the latter so as to form laterally two flow channels 6.

Obviously the present invention is not limited to the embodiments illustrated and described, but comprises all those variations and modifications falling within the broader scope of the inventive idea, as claimed below.

I claim:

1. A swimming flipper comprising a shoe part from which two ribs are located laterally of a fin part, wherein said fin part is connected at one end to said shoe part, while the other end of the fin part is constrained to the ribs in the vicinity of the ends of the ribs, the sides of said fin part being at least partly unconstrained in any way to the ribs, the flipper being movable, in use, between an active phase and a return phase, wherein during the active and return phases the unconstrained part of the fin part and the constrained part of the fin part bend in opposite directions to form a substantially S-shape.

2. A flipper according to claim 1, wherein the ribs are connected together in a zone close to their forward ends by a pair of transverse guide elements spaced from each other by an amount equal to or slightly greater than the thickness of the fin part, the forward end of the fin part extending through the space in between said two guide elements so as to slide freely through of said guide elements.

3. A flipper according to claim 2, in which the fin part has, on a portion thereof projecting forwardly beyond said guide elements, contact parts which limit the movement of the fin part in a direction towards the shoe part.

4. A flipper according to claim 3, in which the position of the said guide elements along said ribs is adjustable.

5. A flipper according to claim 4, in which said guide elements comprise pairs of slender metal rods.

6. A flipper according to claim 4, in which said guide elements comprise a frame with a central slit, fastened between said two-ribs.

7. A flipper according to claim 1, in which the shoe part of the flipper is made of elastomer material having the softness of rubber.

8. A flipper according to claim 1, in which the ribs are made of a material having a rigidity greater than that of a material of the shoe and are made of plastic and/or are provided with reinforcing elements made of hard plastics, engineering polymers or metals or comprising a greater thickness.

9. A flipper according to claim 1, in which said fin part is made of the same material as the shoe part.

10. A flipper according to claim 1, in which the said one end of the fin part adjoins said shoe part in the vicinity of a forward end of the said shoe part.

11. A flipper according to claim 1, in which the said one end of the fin part is spaced from the forward end of the said shoe part so that a part of said fin part is laterally constrained by the ribs.

12. A flipper according to claim 11, in which flow channels are formed in the fin part laterally constrained by the ribs.

13. A flipper according to claim 12, wherein the said other end of the fin part is connected to a front end of the ribs.

* * * * *